US005152705A

United States Patent [19]

Rock

[11] Patent Number: 5,152,705

[45] Date of Patent: Oct. 6, 1992

[54] FLOW ACTUATED FIN SYSTEM FOR WATER SPORT BOARDS AND THE LIKE

[76] Inventor: Frederick N. Rock, 124 Dolores Ave., No. A, San Clemente, Calif.

[21] Appl. No.: 813,699

[22] Filed: Dec. 27, 1991

[51] Int. Cl.[5] ..... B63B 35/79; B63B 35/00; B63B 1/30; B63B 3/38

[52] U.S. Cl. ..... 441/74; 441/65; 441/79; 114/282; 114/130

[58] Field of Search ..... 441/74, 71, 65, 79, 441/37; 114/273, 39.2, 274, 275, 280, 282, 284, 129, 132, 137, 138, 139, 163, 130

[56] References Cited

U.S. PATENT DOCUMENTS

| | | | |
|---|---|---|---|
| 3,317,937 | 5/1967 | Gallagher | 441/74 |
| 3,910,215 | 10/1975 | Soderman | 114/282 |
| 4,321,048 | 3/1982 | Marchese | 441/74 |
| 4,364,324 | 12/1982 | Warner | 114/282 |
| 4,805,546 | 2/1989 | Geller | 441/74 |
| 4,883,436 | 11/1989 | Oakland | 441/74 |
| 5,002,378 | 11/1991 | Bateman | 441/74 |
| 5,014,955 | 5/1991 | Thompson | 441/74 |

FOREIGN PATENT DOCUMENTS

| | | | |
|---|---|---|---|
| 2828859 | 1/1980 | Fed. Rep. of Germany | 441/74 |

*Primary Examiner*—Jesûs D. Sotelo
*Assistant Examiner*—Kenneth Lee
*Attorney, Agent, or Firm*—Roy A. Ekstrand

[57] ABSTRACT

A multiple fin surfboard defines a generally elongated planar surfboard having a plurality of elongated slots defined therein. The slots are grouped close to each end of the surfboard and support a corresponding plurality of fins in a pivotal attachment. The fins each support transverse vanes which are acted upon by a water passage beneath the surfboard to alternatively retract the fins at one end of the surfboard and downwardly extend the fins at the opposite end of the surfboard.

19 Claims, 2 Drawing Sheets

FLOW ACTUATED FIN SYSTEM FOR WATER SPORT BOARDS AND THE LIKE

FIELD OF THE INVENTION

This invention relates generally to the sport of surfing and particularly to the surfboards used therein.

BACKGROUND OF THE INVENTION

Perhaps one of the most exciting and pervasive water sports available in coastal regions of countries throughout the world is the sport known simply as surfing. Surfing may be pursued in virtually any coastal or beach area in which the adjacent body of water provides the periodic on-shore wave pattern having sufficient size or amplitude to be enjoyed by surfaces. Basically, the on-shore movement of periodically spaced waves typically of ocean coastal areas assumes a pattern of widely spaced rolling swells which provide a moving water surge having a downwardly angled shoreward slope which progresses toward the shore and which under many conditions tends to form a washover or curl along its upper crown or edge. In such areas where waves are sufficiently sized to be enjoyable, surfers can be seen waiting off-shore usually assuming prone or sitting positions upon their elongated buoyant surfboards. The basic object of the surfing activity is to observe an approaching wave and thereafter, in a properly timed activity to the waves, approach, paddle or otherwise maneuver the surfboard onto the shoreward slope of the wave in an activity generally referred to as "catching the wave". The maneuvering of the surfboard onto the wave slope is usually achieved by the surfer in an a prone facedown position upon the board. However, once the board has been maneuvered to the shoreward slope and is traveling shorewardly with the wave, surfers generally prefer to stand up upon the board and by skillful manipulation of the board and shifting of their body weight both front to back and side to side maneuver the surfboard along the traveling wave.

While simply catching and riding a significantly sized wave into shore is an exhilarating and exciting experience requiring some skill, surfers having mastered the basic skills often find it more enjoyable to endeavor to perform certain stunts or tricks upon the wave rather than simply riding it into shore. The types of stunts or tricks which may be performed are limited in large part by the skill of the surfer, the wave conditions and the type of surfboard being used.

In addition, to the sport of surfing, a similar water sport activity commonly known as "wakeboarding" is often enjoyed by using a power boat and tow line to ride the boat's wake as the participant is pulled while supported on a somewhat smaller board known as a wakeboard.

The overall or general construction of surfboards and wakeboards has not been significantly changed through the years in that all generally provide a planar buoyant board usually tapered from a maximum width at its center to a relative pointed front and back end. One or more downwardly extending fins are provided on the rear undersurface of the surfboard to provide stability and control within the water. While early surfboards were formed of solid wood and were relatively long and heavy, more recent surfboards which are significantly smaller have been provided using a lightweight rigid core which supports a fiberglass outer "skin". The result is an extremely buoyant surfboard which exhibits greater weight supporting capability and therefore may be fabricated much shorter and smaller than the original heavy wooden boards. Such lightweight high buoyancy surfboards are also provided with one or more downwardly extending fins upon the undersurface of the rear portion of the surfboard. In either style of surfboard or in the many subtle variations that exist in each style, the downwardly extending rear fins are virtually a requirement to allow the surfer to maintain control and maneuverability due to the stabilizing action such fins provide by cutting or biting into the passing water stream.

As surfers have become evermore skillful and the sport of surfing has become increasingly popular, there remains a continuing need in the art for evermore improved and exciting surfboards which permit skilled surfers to maximize their performance and creativity.

SUMMARY OF THE INVENTION

Accordingly, it is a general object of the present invention to provide an improved surfboard. It is a more particular object of the present invention to provide an improved surfboard which facilitates the execution of creative high skilled maneuvers upon the wave surface.

In accordance with the present invention, there is provided for use in moving upon a water surface, a surfboard comprises: an elongated board having first and second ends; first and second pluralities of fins supported near the first and second ends; and means, responsive to relative motion between the board and the water, for raising the first plurality of fins and lowering the second plurality of fins.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS

Figure 1:
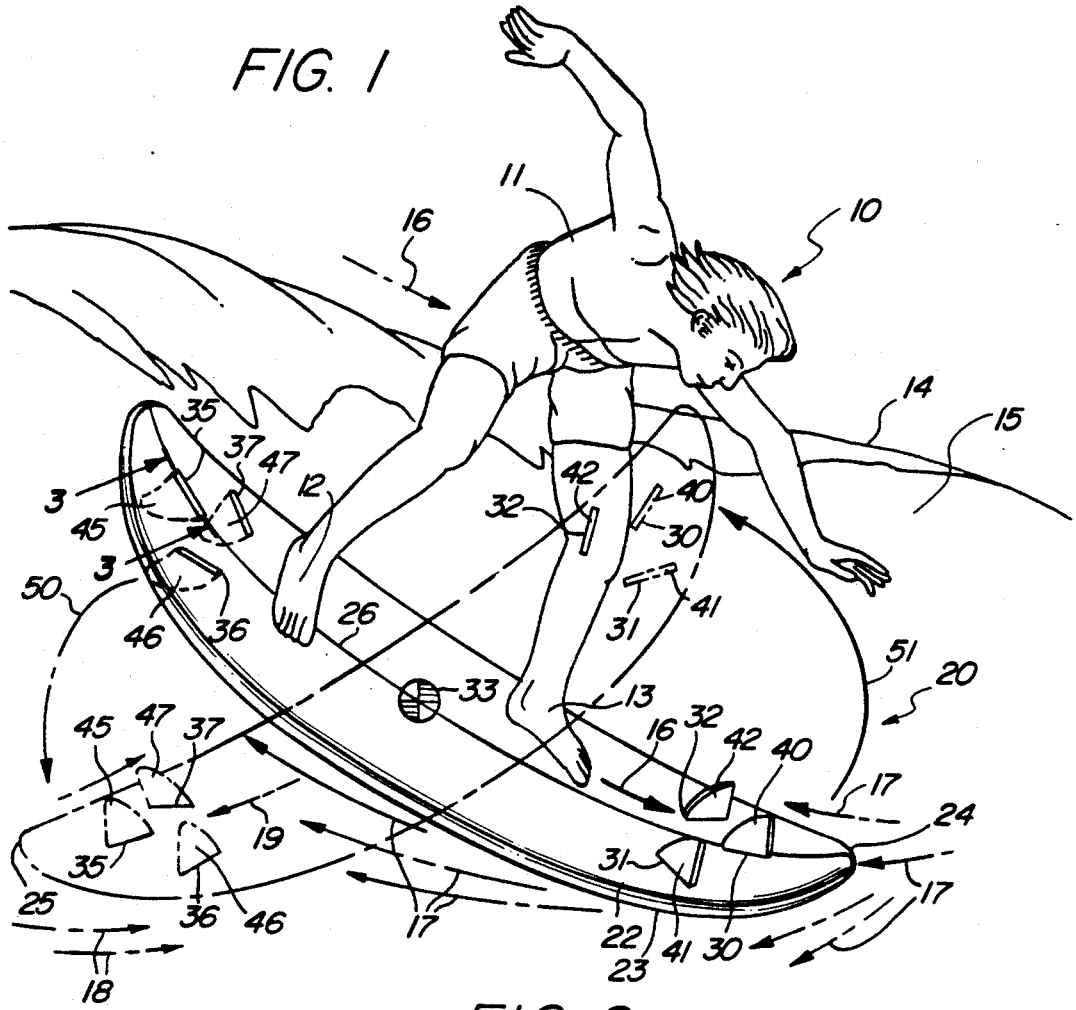
FIG. 1 sets forth a perspective view of a surfer utilizing the present invention surfboard in a typical surfing environment.

FIG. 1 sets forth a perspective view of a typical surface generally referenced by numeral 10 supported upon a surfboard constructed in accordance with the present invention and generally referenced by numeral 20. In the scene depicted in FIG. 1, a typical wave 14 defines a shoreward downwardly angled slope 15 upon which surfer 10 has maneuvered surfboard 20. In accordance with conventional surfing practices, surfer 10 has risen after catching wave 14 to stand upon surfboard 20 and, by careful placement of feet 12 and 13 and the positioning of surfer's body 11, is able to ride slope 15 of wave 14 toward shore in the direction indicated by arrow 16.

Surfboard 20 includes an elongated generally tapered buoyant board member 21 which defines a smooth upper surface 22 and a corresponding smooth undersurface 23. The tapered structure of buoyant board 21 provides a maximum surface area near its center 33 and further defines a pair of rounded tips or points 24 and 25. In accordance with an important aspect of the present invention, buoyant board 21 further defines a triad of elongated slots 30, 31 and 32 positioned in a generally symmetrical arrangement near tip 24. By means set forth below in greater detail, a corresponding plurality of pivotally supported fins 40 through 42 are supported within and extend upwardly through slots 30 through 32 respectively. In further accordance with an important aspect of the present invention, buoyant board 21 further defines a second triad of elongated slots 35 through 37 near tip 25 which are also positioned in a generally symmetrical arrangement about the center line 26 of board 21. In further similarity to slots 30 through 32, slots 35 through 37 support a corresponding plurality of pivotally supported fins 45 through 47 respectively.

In the position shown in FIG. 1, surfer 10 and surfboard 20 are maneuvered by surfer 10 along slope 15 to propel surfer 10 and surfboard 20 in the direction of arrow 16. As surfboard 20 moves across the water surface in the direction of arrow 16, a relative flow between the underlying water and surfboard 20 in the direction of arrows 17 is produced. In accordance with an important aspect of the present invention set forth below in greater detail, the flow of water along undersurface 23 of surfboard 20 from tip 24 toward tip 25 in the direction of arrows 17 pivots fins 40 through 42 upwardly to the raised position shown in FIG. 1 in which fins 40 through 42 are supported in a raised position extending through slots 30 through 32 and, as is set forth below are generally removed from the underlying water stream beneath undersurface 23.

Conversely, and in further accordance with an important aspect of the present invention set forth below, the flow of water in the direction of arrow 17 is operative upon the downstream trio of fins 45 through 47 to orient them in downwardly extending positions in which fins 45 through 47 extend downwardly from undersurface 23 and thus cut through or bite into the underlying water beneath surfboard 20.

In short, by means set forth below in greater detail, the passage of water beneath surfboard 20 as it moves along wave slope 15 raises the triad of fins at the upstream end of surfboard 20 to the raised position shown for fins 40 through 42 while simultaneously lowering the downstream triad of fins 45 through 47. Thus, as surfboard 20 moves through the water, the water action upon each of the fin triads configures the surfboard in the appropriate fin configuration which provides downwardly extending rear fins for use by surfer 10 in maneuvering the present invention surfboard.

In further accordance with an important aspect of the present invention, surfer 10 may choose to maneuver or weight shift upon upper surface 22 of surfboard 20 to reorient surfboard 20 to an alternate position such as that shown by dashed outline in FIG. 1. In further accordance with an important aspect of the present invention, the result of such maneuvering by surfer 10 is to reverse the relative position of tips 24 and 25 with respect to the water overwhich surfboard 20 is moving such that tip 25 now assumes the frontal or upstream position and tip 24 assumes the rear or downstream position as surfer 10 and surfboard 20 move in the direction indicated by arrow 19. Once again, the motion of surfboard 20 in the direction of arrow 19 produces a corresponding relative motion between surfboard 20 and the underlying water surface which is shown as water flow arrows 18. By means set forth below in greater detail, the relative water flow with respect to board 20 shown by arrows 18 raises fins 45 through 47 to the upwardly extending vertical position shown in dashed line representation in FIG. 1 while simultaneously lowering fins 40 through 42 to the downwardly extending positions also shown in FIG. 1.

Thus, in accordance with an important aspect of the present invention, surfer 10 has been able to execute a maneuver which might otherwise not be possible with conventional surfboards in which the fin configurations remain fixed. More simply stated, the present invention surfboard and the pivotal fin support for the dual triads of fins thereon cooperate to maintain a downstream fin configuration necessary for control while retracting or raising the upstream fin triad regardless of which end of surfboard 20 is extended forwardly. The automatic downward extension of the downstream or rear fin triad is essential to provide the above-mentioned control capability for the surfer. Concurrently, the automatic retraction or raising of the upstream triad of fins maintains the upstream fins at positions which avoid interference with the board's maneuverability and the capability of the surfer to execute rapid turns and other maneuvers.

It will be apparent to those skilled in the art that an increased and more exciting variety of maneuvers may be executed by the user utilizing the present invention board. It will be further apparent to those skilled in the art that the present invention surfboard is equally compatible with conventional surfing in which the surfer more or less typically rides the wave to shore. It will be further apparent to those skilled in the art that surfboard 20 may be fabricated in a variety of shapes and configurations. However, it has been found advantageous to fabricate the present invention surfboard in a generally symmetrical configuration and in which buoyant board 21 is formed in a generally symmetrical nose to tail about center 33. However, other board configurations may be utilized without departing from the spirit and scope of the present invention.

It will be equally apparent to those skilled in the art that in some environments it may be desirable to fabricate surfboards and wakeboards which utilize the present invention pivotally supported fin structures set forth below in different combinations from those shown in FIG. 1. For example, the present invention fin structures may be used on the above-mentioned wakeboards by participants being towed behind boats.

Figure 2:
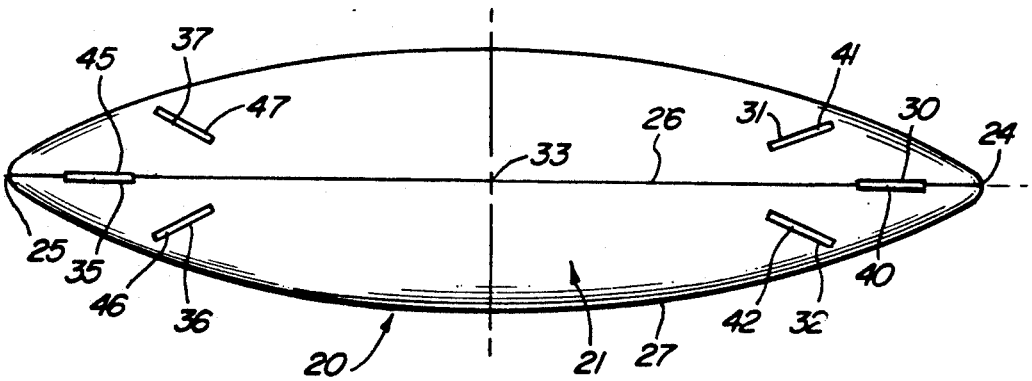
FIG. 2 sets forth a bottom view of the present invention surfboard.

FIG. 2 sets forth a bottom view of the present invention surfboard. As can be seen, surfboard 20 includes a buoyant board 21 which is tapered to oppositely extending tips 24 and 25 and which is generally symmetrical about a center line 26 and a center 33. As described above, buoyant board 21 defines a trio of elongated slots 30 through 32 near tip 24 and a similar trio of slots 35 through 37 near tip 25. As is also seen in the preferred embodiment shown in FIG. 2, slots 30 through 32 and 35 through 27 are generally symmetrical about center line 26 and are also symmetrical with respect to center 33. In its preferred configuration, it has been found that angling slots 31 and 32, as well as slots 36 and 37, at acute angles to center line 26 so as to diverge from tips 24 and 25 respectively provides distinct advantages in the operation of surfboard 20. It will be apparent to those skilled in the art, however, that parallel or other angled combinations of slots may be utilized in accordance with the present invention. As is also mentioned above, slots 30 through 32 support a corresponding trio of pivotally supported fins 40 through 42 while slots 35 through 37 support a trio of fins 45 through 47 respectively. In the embodiment shown in FIG. 2, slots 30 through 32 and 35 through 37 are shown simply as elongated slots formed in buoyant board 21 which receive pivotally attached fins 40 through 42 and 45 through 47. However, while such simplified fabrication may be appropriate in board materials having sufficient strength and rigidity to provide pivotal attachment between fins 40 through 42 and 45 through 47, it has been found advantageous to utilize a structure such as that set forth below in FIGS. 3 and 4 to pivotally secure fins 40 through 42 and 45 through 47 within their respective slots for added strength and reliability.

Figure 3:
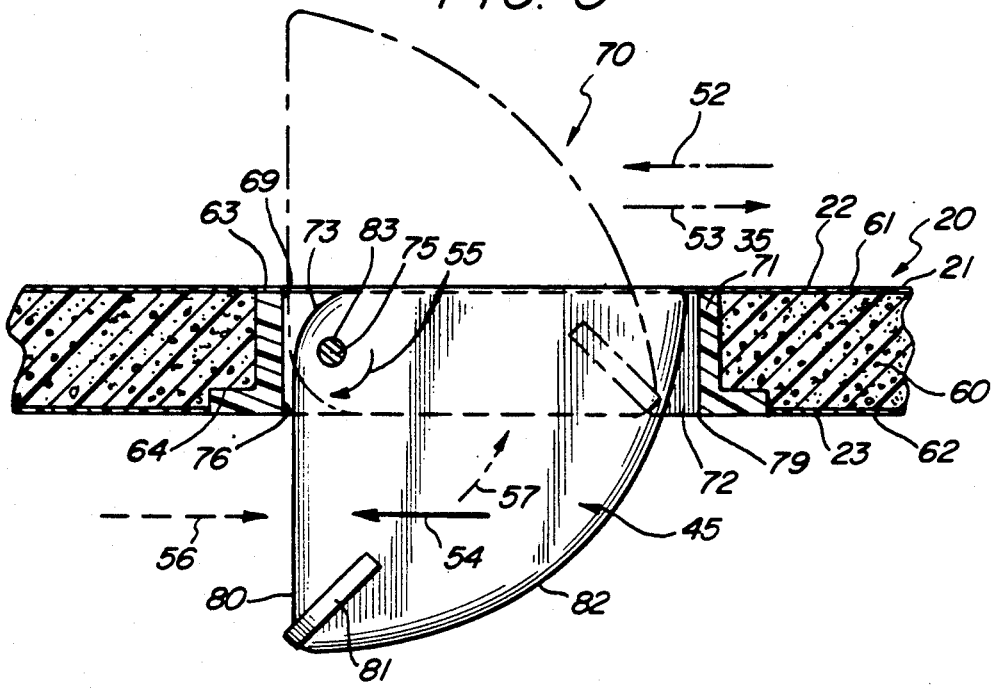
FIG. 3 sets forth a section view of the fin structure of the present invention surfboard taken along section lines 3-3 in FIG. 1.

It should also be noted that while the embodiment set forth in FIGS. 1 and 2 is a surfboard, the invention may be used equally well in combination with other water sport boards such as the above-mentioned wakeboards FIG. 3 sets forth a section view of the present invention fin support structure taken along section lines 3—3 in FIG. 1. As described above, surfboard 20 includes a buoyant board 21 which supports the plurality of pivotally supported fins sets forth above. While buoyant board 21 may be fabricated using any of the available surfboard manufacturing materials and techniques, it has been found advantageous to form buoyant board 21 using a lightweight rigid foam core 60 which in accordance with conventional fabrication techniques is carefully shaped to the desired board contours. In further accordance with conventional fabrication techniques, foam core 60 is enclosed in an outer "skin" of fiberglass to additionally strengthen buoyant board 21 and to seal foam core 60. Thus, foam core 60 supports an upper fiberglass layer 61 and a lower fiberglass layer 62 which in turn form upper surface 22 and lowered surface 23 respectively.

In accordance with the present invention, foam core 60 further defines a plurality of elongated generally rectangular slots 63 having outwardly extending surrounding recesses 64 on the lower sides thereof. A fin receptacle 71 fabricated in the manner set forth below in FIG. 4 defines a generally rectangular fin guide 77 and outwardly extending flange 78 which are received within slot 63 and recess 64 of foam core 60. Fin receptacle 71 further defines a rectangular elongated fin slot 72 which generally corresponds to slot 35 in fiberglass layer 61. Correspondingly, fiberglass layer 62 defines a lower slot 79 also generally coextensive with fin slot 72 in fin receptacle 71. Fin receptacle 71 further defines a pair of extending limit stops 76 and 69. In accordance with the structure set forth below in greater detail, fin receptacle 71 defines an aperture 74 which receives a generally cylindrical pin 75. A fin member 45 defines an aperture 83 and is received within fin slot 72 and pivotally secured to fin receptacle 71 by the extension of pin 75 through aperture 83. Fin 45 further defines a curved generally sharpened leading edge 82 and a foiled trailing edge 80. Also, the fins of surfboard 20 may be symmetrically foiled or cross-sectioned or, alternatively, may form hydrofoil cross-sections in accordance with the intended use and design of surfboard 20. A generally planar vane 81 is supported upon trailing tip 80 and provides a generally planar member positioned transverse to the plane of fin 45 preferably at an acute angle (approximately thirty-five degrees.

In accordance with the preferred fabrication of fin 45 within fin receptacle 71 set forth below in connection with FIG. 4 in greater detail, fin 45 is initially assembled to fin receptacle 71 afterwhich pin 75 is inserted through apertures 74 of fin receptacle 71 and aperture 83 of fin 45 to complete the fin assembly generally referenced by numeral 70 (seen in FIG. 4). Thereafter, fin assembly 70 is installed within slot 63 and recess 64 of foam core 60 prior to the application of fiberglass layers 61 and 62. Fin receptacle 71 may be secured within slot 63 and recess 64 using a conventional adhesive material or the like. Thereafter, the fiberglass outer layer of buoyant board 21 including upper layer 61 and lower layer 62 is applied to foam core 60 in accordance with conventional fabrication techniques and configured to define slots 35 and 79. It should be noted that in its preferred form, fiberglass layers 61 and 62 overlap fin receptacle 71 to provide a more secure attachment of fin receptacle 71 to buoyant board 21

In operation, as surfboard 20 travels in the direction indicated by arrow 52, a resulting water force of the water through which surfboard 20 passes is produced in the direction of arrow 54. This water force flows easily about sharpened edge 82 and along the side surfaces of fin 45. However, vane 81 provides a substantial surface area for the flowing water in the direction of arrow 54 which in turn produces a rearward force upon fin 45 pivoting fin 45 in the direction of arrow 55 until trailing edge 80 of fin 45 abuts limit stop 76. Thereafter, the continued motion in the direction of arrow 52 of surfboard 20 maintains a water force in the direction of arrow 54 which in turn maintains fin 45 in the solid line position shown in FIG. 3.

Conversely, when surfboard 20 is operated in the reverse direction indicated by arrow 53, a corresponding water force indicated by dashed line arrow 56 is applied to vane 81. The result of water force upon vane 81 is to pivot fin 45 about pin 75 in the direction indicated by arrow 57. As surfboard 20 continues to move in the direction of arrow 53, the water force against vane 81 pivots or rotates fin 45 to the raised position shown in dashed line form in FIG. 3. As can be seen, when fin 45 has been raised to the dashed line position shown, it is virtually removed from the water stream passing along lower surface 23.

Thus, in accordance with an important aspect of the present invention, fin 45 will assume either a lowered or raised position in response to opposite direction water flows beneath the undersurface of surfboard 20.

Figure 4:
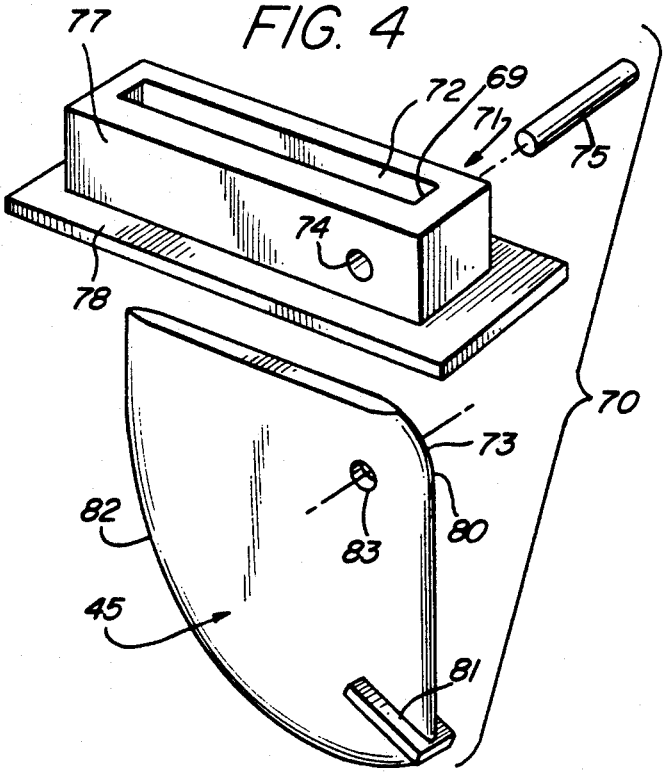
FIG. 4 sets forth a perspective assembly view of the pivotal fin assembly of the present invention surfboard.
Figure 4A:
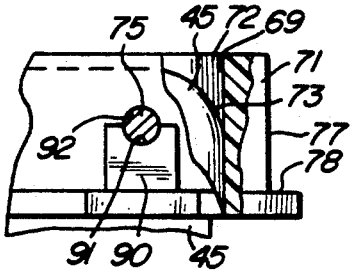
FIG. 4A sets forth a partial section view of an alternate embodiment of the present invention surfboard.

It should be noted that while the structure set forth in FIG. 3 details the assembly and pivotal support of fin 45 in great detail, it should be understood that the remaining fins of surfboard 20 set forth in FIGS. 1 and 2 are fabricated in identical manner and thus the descriptions which are set forth in FIGS. 3, 4 and 4A relating to fin 45 and its support structure apply equally well to fins 46 and 47 as well as fins 40 through 42.

FIG. 4 sets forth a perspective assembly view of a fin assembly constructed in accordance with the present invention and generally referenced by numeral 70. Fin assembly 70 includes an elongated generally rectangular fin receptacle 71 defining a rectangular fin guide 77 and an outwardly extending surrounding generally rectangular flange 78. Fin receptacle 71 and flange 78 further define an elongated rectangular fin slot 72. Fin guide 77 further defines a pair of apertures 74. Fin guide 77 further defines a pair of limit stops 69 and 76.

A fin 45 defines a generally planar member having a sharpened curved leading edge 82 and a generally straight trailing edge 80. Fin 45 further defines an aperture 83 and curved surface 73. A generally planar vane 81 is supported upon trailing edge 80 and provides a planar member extending generally transversely to the plane of fin 45. In accordance with the present invention, fin 45 is assembled to fin receptacle 71 by initially installing the upper portion of fin 45 within fin slot 72 passing through flange 78 and into fin guide 77 until aperture 83 is aligned with apertures 74 in fin guide 77. Thereafter, pin 75 is inserted through apertures 74 of fin guide 77 and aperture 83 of fin 45. Pin 75 may be secured within apertures 74 by an interference or force-fit therebetween or, if preferred, other attachment mechanisms such as adhesive, thermal welding or the like may be employed to secure pin 75. At this point, fin assembly 70 is complete and is ready for installation within foam core 60 in the manner described above.

FIG. 4A sets forth a partial section view of an alternate embodiment of the present invention which differs from that set forth in FIGS. 3 and 4 in that it provides for a two-step assembly in which fin receptacle 71 may be initially fitted within foam core 60 without the preassembly of fin 45 and pin 75 therein. The advantage to this alternate embodiment is that fin receptacle 71 may be enclosed within fiberglass layers 61 and 62 prior to the assembly of fin 45 thereby making the formation of slots 35 and 79 in fiberglass layers 61 and 62 respectively an easier task. Specifically, with respect to FIG. 4A, fin receptacle 71 as set forth therein differs from the embodiment shown in FIGS. 3 and 4 in that receptacle 71 defines a pair of half cylindrical journals 92 in place of apertures 74 in the embodiment of FIG. 4. In addition, a pair of lock tabs such as lock tab 90 define corresponding half cylindrical journals such as journal 91 which when inserted into fin receptacle 71 complete a cylindrical aperture such as aperture 74 in the embodiment of FIG. 4.

Thus, the embodiment of FIG. 4A permits fin receptacle 71 with fin 45 and lock tabs 90 removed to be fiberglassed into foam core 60. Thereafter, pin 75 is passed through aperture 83 of fin 45 and the combination thereof is inserted into fin slot 72 until pin 45 rests within journals 92 of receptacle 71. The assembly is completed by the insertion of lock tabs such as lock tab 90 into fin receptacle 71 to captivate pin 75 between journals 91 and 92. Thereafter, look tab 90 may be secured using conventional attachment means such as adhesives, thermal welding or the like. In the alternative, lock tab 90 may be removably secured to fin receptacle 71 using conventional fasteners or the like to provide for easy removal of fin 45 in the event different fin configurations are desired to meet the variety of surfing configurations encountered throughout the world.

What has been shown is a novel and improved surfboard having a plurality of pivotally secured retractable fins at each end of the board. The fins respond to the direction of water flow beneath the surfboard to properly configure the respective fin sets in the appropriate configuration for optimum control and performance. In addition, the availability of retractable fins on each end of the surfboard greatly increases the flexibility and capability of the resulting surfboard particularly in the area of maneuverability or stunt performance and surfing both forward and backward with equal control.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. For use upon a water surface, a surfboard comprising:

an elongated board member defining first and second ends;

a first fin secured to said board proximate said first end having means, responsive to relative motion between said board and the water beneath it, for extending said first fin into the water in response to a first direction of motion and retracting said first fin in response to a second opposite direction of motion; and a second fin secured to said board proximate said second end having means, responsive to relative motion between said board and the water beneath it, for retracting said second fin in response to said first direction of motion and extending said second fin into the water in response to said second direction of motion.

2. A surfboard as set forth in claim 1 wherein said first and second fins are pivotally secured to said elongated board and include respective first and second planar portions which are acted upon by relative motion of said board through the water to produce pivotal motion thereof.

3. A surfboard as set forth in claim 2 wherein said elongated board defines first and second elongated slots proximate said first and second ends and wherein said first and second fins are pivotally secured therein.

4. A surfboard as set forth in claim 3 wherein said surfboard further includes first and second elongated housings having pivotal fin supports therein received within said first and second elongated slots.

5. A surfboard as set forth in claim 4 wherein said elongated board defines a major and a minor axis and is generally symmetrical thereabout.

6. A surfboard as set forth in claim 5 wherein said elongated board is symmetrically curved about said major axis to form a generally convex end to end rocker curved undersurface.

7. A surfboard as set forth in claim 6 further including a first pair of fins supported on each side of and generally identical to said first fin and a second pair of fins supported on each side of and generally identical to said second fin.

8. A surfboard as set forth in claim 7 wherein said first and second pairs of fins are symmetrically located with respect to said major and minor axes.

9. A surfboard as set forth in claim 8 wherein said fins in said first and second pairs of fins are angled with respect to said major axis to converge toward said first and second respective ends.

10. For use in moving upon a water surface, a surfboard comprising:

an elongated board having first and second ends;

first and second pluralities of fins supported near said first and second ends; and means, responsive to relative motion between said board and said water, for raising said first plurality of fins and lowering said second plurality of fins.

11. A surfboard as set forth in claim 10 wherein said first and second pluralities of fins are oppositely raised and lowered in response to opposite directions of said relative motion.

12. A surfboard as set forth in claim 11 wherein said first and second pluralities of fins are triads and wherein two fins in each triad are convergingly angled toward each other.

13. A surfboard comprising:

an elongated board defining major and minor axes and first and second ends;

first and second oppositely oriented pluralities of fins supported near said first and second ends, said first and second pluralities of fins being oppositely moved between raised and lowered positions in response to motion of said board through water generally along said major axis.

14. A surfboard as set forth in claim 13 wherein each of said fins include a larger generally planar portion and a smaller transverse vane portion.

15. A surfboard as set forth in claim 14 wherein said elongated board includes first and second pluralities of elongated fin receptacles having elongated slots therein and means for pivotally securing a respective fin therein.

16. A surfboard as set forth in claim 15 wherein said first and second pluralities of fins are removably secured within said respective first and second pluralities of fin receptacles.

17. For use in moving upon a water surface, a finned board comprising:

an elongated board having first and second ends;

first and second pluralities of fins supported near said first and second ends; and means, responsive to relative motion between said board and said water, for raising said first plurality of fins and lowering said second plurality of fins.

18. A finned board as set forth in claim 10 wherein said first and second pluralities of fins are oppositely raised and lowered in response to opposite directions of said relative motion.

19. A finned board as set forth in claim Il wherein said first and second pluralities of fins are triads and wherein two fins in each triad are convergingly angled toward each other.

* * * * *